US005796915A

United States Patent [19]

Hsing-Lin

[11] Patent Number: 5,796,915

[45] Date of Patent: Aug. 18, 1998

[54] HOT WATER HEATER WITH REFUSE INCINERATOR

[76] Inventor: Hsieh Hsing-Lin, P. O. Box 82-144, Taipei, Taiwan

[21] Appl. No.: 725,306

[22] Filed: Oct. 2, 1996

[51] Int. Cl.[6] ..... A47J 27/00; A47J 31/54; F24H 1/18

[52] U.S. Cl. ..... 392/441; 110/250; 126/101

[58] Field of Search ..... 392/441, 496; 219/385, 390, 399, 472, 406, 407; 126/101; 110/250; 122/2, 4 A

[56] References Cited

U.S. PATENT DOCUMENTS

| | | | |
|---|---|---|---|
| 2,269,055 | 1/1942 | Gower | 126/101 |
| 2,533,508 | 12/1950 | Riu | 126/101 |
| 3,619,563 | 11/1971 | Hirst | 219/407 |
| 4,296,712 | 10/1981 | Vogt | 122/2 |
| 4,461,242 | 7/1984 | Black | 126/101 |
| 5,291,839 | 3/1994 | Wong | 110/250 |
| 5,536,114 | 7/1996 | Wetmore et al. | 110/250 |
| 5,615,627 | 4/1997 | Marr, Jr. | 110/250 |

*Primary Examiner*—John A. Jeffery
*Assistant Examiner*—Jiping Lu
*Attorney, Agent, or Firm*—A & J

[57] ABSTRACT

A hot water heater burns inflammable waste articles to heat water. A primary combustion chamber is defined within a water chamber for burning inflammable waste articles. A heating element is mounted around the primary combustion chamber to produce heat for burning off the inflammable waste articles in the primary combustion chamber. An electric heater is mounted inside the water chamber to heat water in the water chamber directly when the heating element is inoperative.

1 Claim, 3 Drawing Sheets

HOT WATER HEATER WITH REFUSE INCINERATOR

BACKGROUND OF THE INVENTION

1. Field of the Invention

This invention relates to hot water heaters, and relates more particularly to such a hot water heater which has a combustion chamber for burning inflammable waste articles.

2. Description of the Prior Art

This invention relates to hot water heaters, and relates more particularly to such a hot water heater which has a combustion chamber for burning inflammable waste articles, permitting produced heat energy to be absorb for heating water.

Conventional home electric hot water heaters commonly use an electric heater for heating water to the desired temperature. These electric hot water heaters simply heat water to the desired temperature without providing any additional function. When heating, much heat energy is wasted.

SUMMARY OF THE INVENTION

This invention provides a hot water heater which burns inflammable waste articles when heating water. According to the preferred embodiment of the present invention, a primary combustion chamber is defined within a water chamber for burning inflammable waste articles, a heating element is mounted around the primary combustion chamber and controlled to produce heat for causing inflammable waste articles to be burned in the primary combustion chamber, and an electric heater is mounted inside the water chamber and controlled to heat water in the water chamber directly when the heating element does no work.

DETAILED DESCRIPTION OF THE PREFERRED EMBODIMENT

Figure 1:
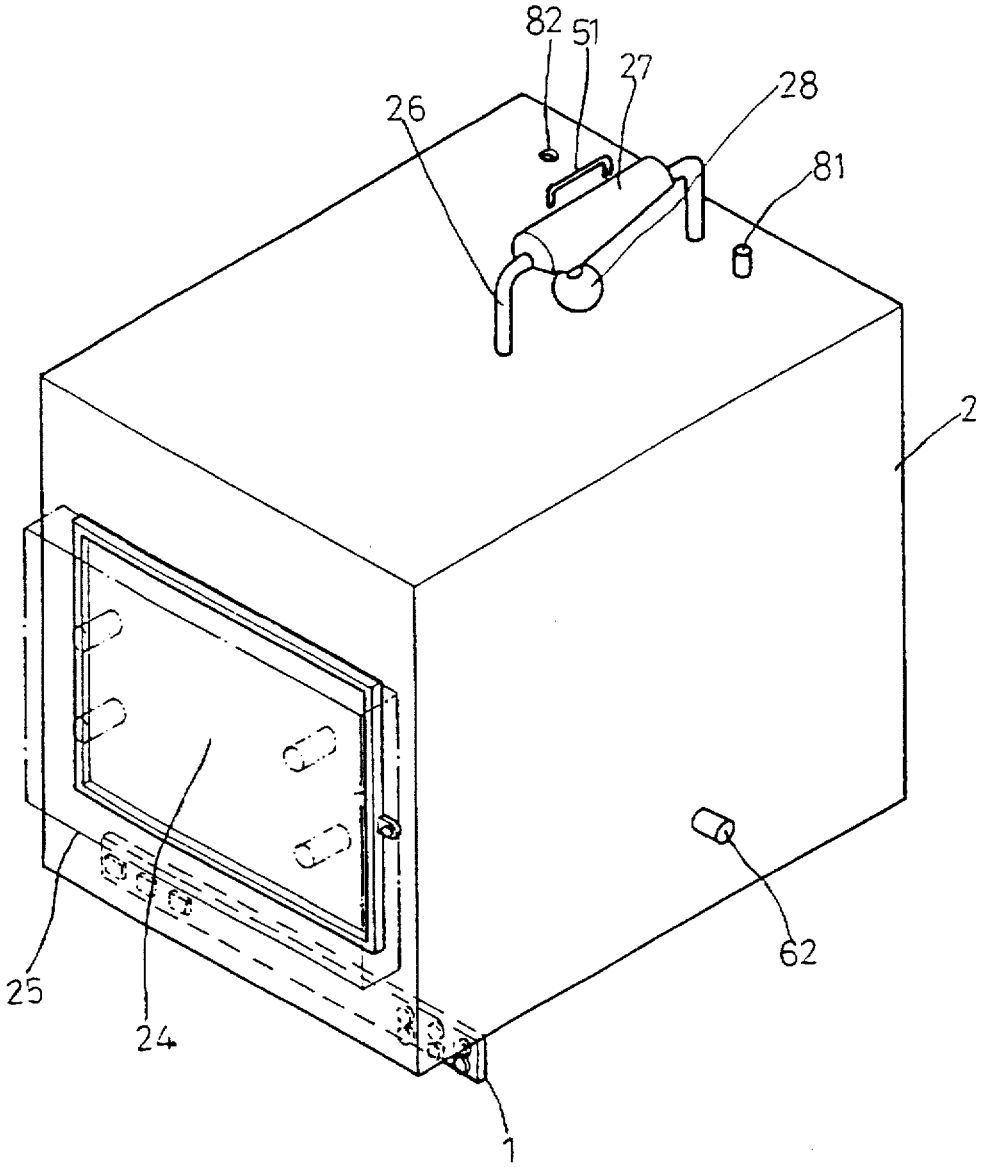
FIG. 1 is a perspective elevational view of a hot water heater according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
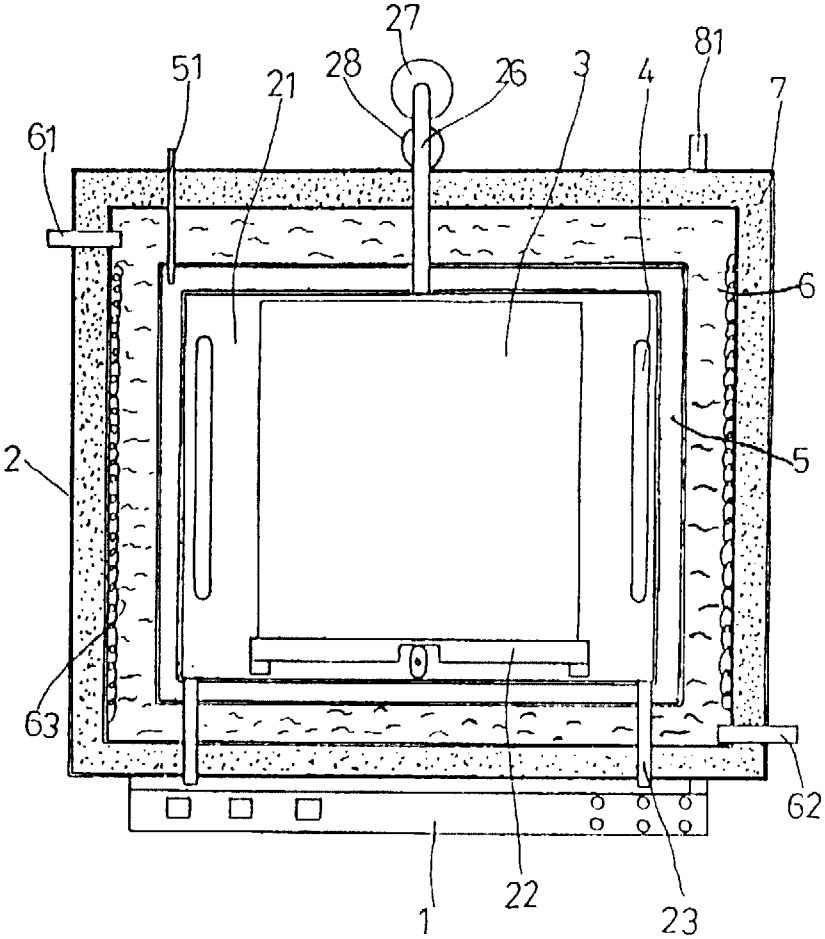
FIG. 3 is similar to FIG. 2 but showing the dustbin lifted.
Figure 2:
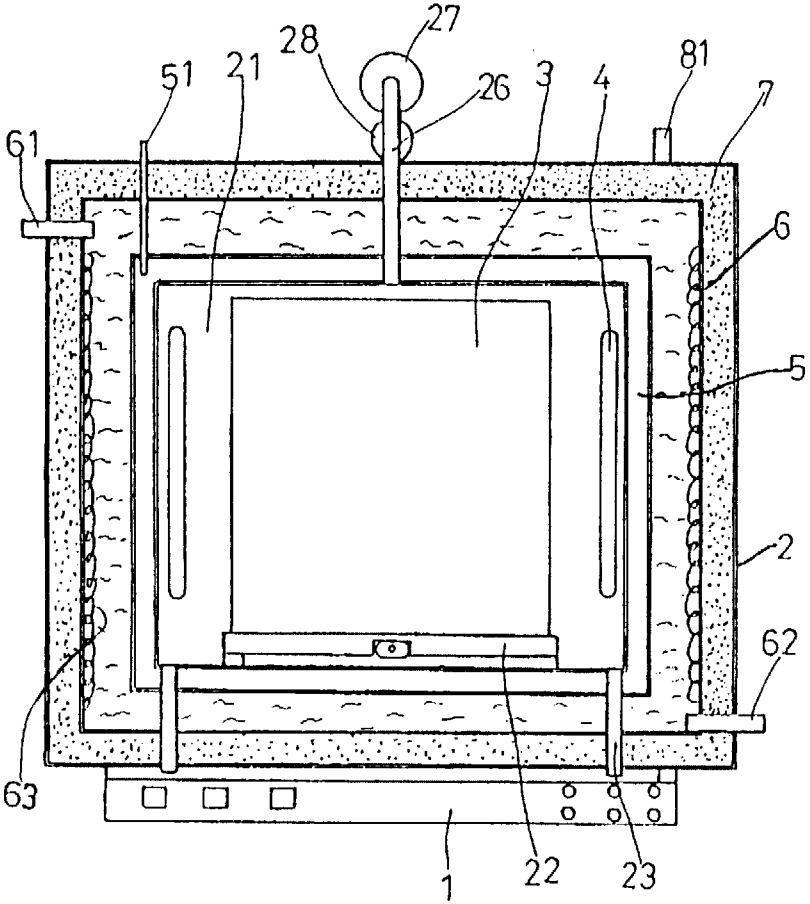
FIG. 2 is a front view of the hot water heater shown in FIG. 1.

Referring to FIGS. 1, 2, and 3, a control panel 1 is mounted on a housing 2 at the bottom. The housing 2 comprises a primary combustion chamber 21. A stand 22 is mounted inside the primary combustion chamber 21 of the housing 2. The stand 22 holds a dustbin 3, and can be lifted when twisted. Air vents 23 are made through the bottom side of the housing 2 for circulation of air through the primary combustion chamber 21. The housing 2 has a safety door 24, which closes/opens the primary combustion chamber 21. The safety door 24 expands when hot and shrinks when cold. When the temperature inside the primary combustion chamber 21 surpasses a predetermined value, the safety door 24 expands to such an extent that it is locked in the closed position. A heat insulation cover shell 25 is hinged to the safety door 24 on the outside for protection. An exhaust pipe 26 extends from the primary combustion chamber 21 to the top of the housing 2 on the outside. A heating element 4 is mounted inside the housing 2 around three sides of the primary combustion chamber 21. The heating element 4 produces heat at about 500° C. about 25 minutes after heating, and then maintains the temperature at the range. An air chamber 5 is defined inside the housing 2 around the primary combustion chamber 21. An air pipe 51 extends from the air chamber 5 to the outside of the housing 2. A water chamber 6 is defined within the housing 2 around the air chamber 5. A cold water supply pipe 61 and a hot water supply pipe 62 are respectively mounted in the housing 2 at two opposite sides at different elevations, for guiding cold water into the water chamber 6 and hot water out of the water chamber 6 respectively. An electric heater 63 is installed inside the water chamber 6, and controlled to heat water in the water chamber 6. A heat insulation layer 7 is mounted inside the housing 2, and covered around the water chamber 6.

Figure 4:
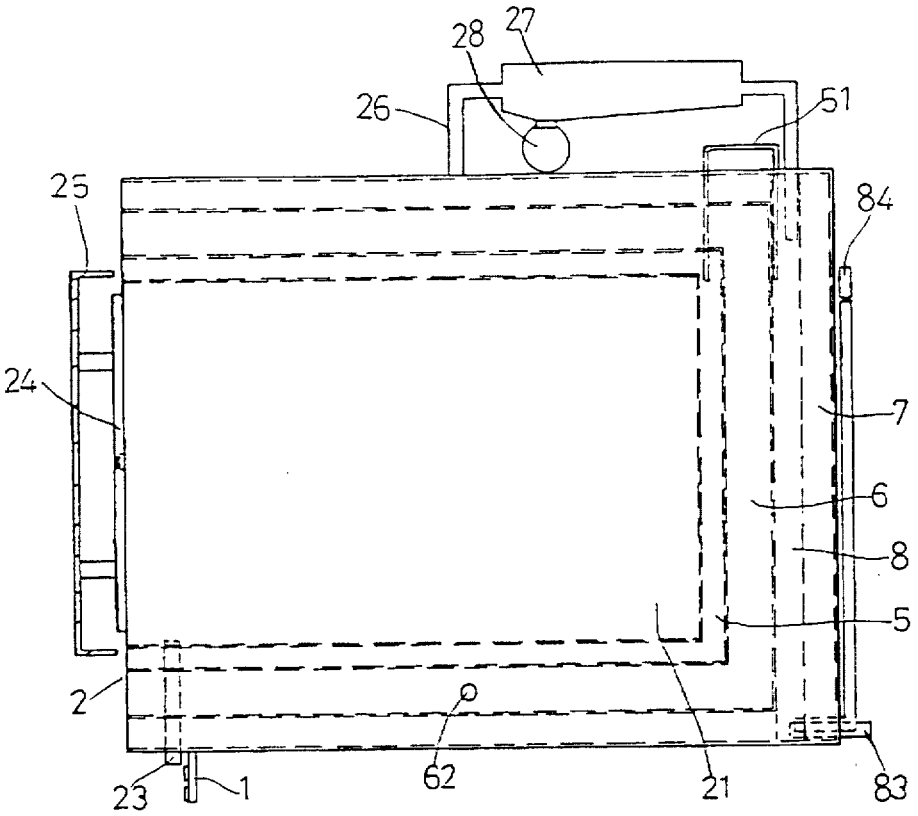
FIG. 4 is a side plain view of the hot water heater shown in FIG. 1.
Figure 5:
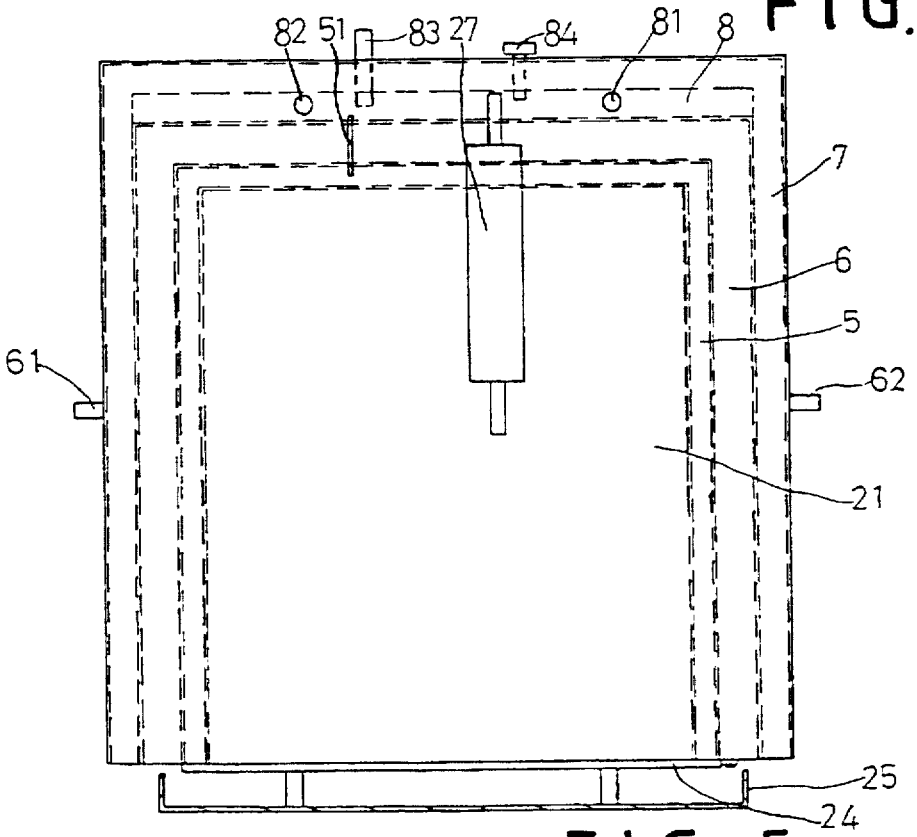
FIG. 5 is a top plain view of the hot water heater shown in FIG. 1.

Referring to FIGS. 4 and 5, the exhaust pipe 26 has one end connected to the primary combustion chamber 21, and an opposite end extended to the outside of the housing 2 and connected to a gas filter 27. The gas filter 27 comprises a detachable transparent ash collector 28 at the bottom, which collects ashes removed from the gas filter 27. The gas filter 27 has one end connected to the exhaust pipe 26, and an opposite end connected to a water filtration chamber 8 at the back side of the housing 2. The water filtration chamber 8 has an exhaust hole 81 and a water filling hole 82 at the top, and an drain pipe 83 at the bottom. Further, a water level indicator 84 is provided for showing the level of water in the water filtration chamber 8.

When in use, inflammable waste articles can be put in the dustbin 3, which is made from heat resisting material. When the dustbin 3 is put in the stand 22 inside the primary combustion chamber 21, the stand 22 is lifted, permitting the top open side of the dustbin 3 to be disclosed close to the exhaust pipe 26, so that waste gas can be guided into the exhaust pipe 26. When the safety door 24 and the heat insulation cover shell 25 are closed, cold water is guided into the water chamber 6 through the cold water supply pipe 6, and then the heating element 4 is turned to produce heat. About 25 minutes after heating, the temperature of the heating element 4 reaches 500° C. Inflammable waste articles are then burned to ash. When burning, outside fresh air circulates through the primary combustion chamber 21 via the air vents 23. At the same time, intake water in the water chamber 6 is heated to about 60° C. Because the heating element 4 is isolated from the water chamber 6 by the air chamber 5, water in the water chamber 6 will not be excessively boiled. When the temperature of air in the air chamber 5, hot air is allowed to pass to the outside through the air pipe 51. Because the water chamber 6 is insulated by the heat insulation layer 7, heat energy does not escape from the water chamber 6. When exhaust gas passes from the primary combustion chamber 21 through the exhaust pipe 26 into the gas filter 27, ashes are removed and collected in the ash collector 28. After filtration through the gas filter 27, exhaust gas is guided to the water filtration chamber 8 at which the temperature of exhaust gas is lowered and, impurities carried in exhaust gas are left on the bottom. Filtered waste gas is then guided out of the housing 2 through the exhaust hole 81, and waste water can be further drained away from the water filtration chamber 8 through the exhaust pipe 83. When there is no inflammable waste articles to be disposed of, the heating element 4 is turned off, and the electric heater 63 can be turned on to heat water in the water chamber 6.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A hot water heater comprising:

a primary combustion chamber having air circulation holes at a bottom side, and an access door at a front side;

a stand mounted inside said primary combustion chamber;

a heat-resisting dustbin put in said stand and adapted for holding inflammable waste articles for burning in said primary combustion chamber;

an exhaust pipe adapted for guiding exhaust gas out of said primary combustion chamber;

a gas filter connected to said exhaust pipe and adapted for removing ashes from exhaust gas, said gas filter comprising a transparent ash collector adapted for collecting removed ashes;

a water filtration chamber adapted for receiving and cooling exhaust gas from said gas filter, said water filtration chamber having a drain pipe at a bottom side, an exhaust hole and a water filling hole at a top side;

a heating element mounted around said primary combustion chamber and controlled to produce heat at 500° C. for causing inflammable waste articles to be burned;

an air chamber surrounding said primary combustion chamber and having an air pipe extending to the outside;

a water chamber disposed around said air chamber for holding water and receiving heat energy transmitted from said primary combustion chamber through said air chamber;

a heat isolation layer covered around said water chamber;

a cold water supply pipe and a hot water supply pipe respectively connected to said water heating chamber, and adapted for guiding cold water into said water chamber and hot water out of said water chamber respectively;

an electric heater installed inside said water chamber, and controlled to heat water in said water chamber when said heating element does no work; and a water level indicating means adapted for indicating water level in said water filtration chamber.

* * * * *